US011098393B2

(12) United States Patent
Okamoto

(10) Patent No.: US 11,098,393 B2
(45) Date of Patent: Aug. 24, 2021

(54) MARTENSITIC STAINLESS STEEL FOIL AND MANUFACTURING METHOD THEREOF

(71) Applicant: HITACHI METALS, LTD., Tokyo (JP)

(72) Inventor: Takuya Okamoto, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 244 days.

(21) Appl. No.: 16/081,733

(22) PCT Filed: Mar. 8, 2017

(86) PCT No.: PCT/JP2017/009238
§ 371 (c)(1),
(2) Date: Aug. 31, 2018

(87) PCT Pub. No.: WO2017/154981
PCT Pub. Date: Sep. 14, 2017

(65) Prior Publication Data

US 2019/0071758 A1 Mar. 7, 2019

(30) Foreign Application Priority Data

Mar. 9, 2016 (JP) ..... JP2016-046217

(51) Int. Cl.
*B21B 1/40* (2006.01)
*C22C 38/22* (2006.01)
(Continued)

(52) U.S. Cl.
CPC ..... *C22C 38/22* (2013.01); *B21B 1/40* (2013.01); *B21B 3/02* (2013.01); *C21D 6/002* (2013.01);
(Continued)

(58) Field of Classification Search
CPC ..... B21B 1/40; B21B 2267/06; B21B 3/02; C21D 2211/004; C21D 2211/005;
(Continued)

(56) References Cited

U.S. PATENT DOCUMENTS 5,346,559 A * 9/1994 Ushigami ..... C21D 8/1233 148/111
2006/0070685 A1* 4/2006 Grell ..... F16C 33/64 148/211
2007/0218333 A1 9/2007 Iwamoto

FOREIGN PATENT DOCUMENTS

CN 1875128 A 12/2006
CN 102242860 A 11/2011
(Continued)

OTHER PUBLICATIONS

NPL: Online English translation of JP-2012214866-A, Nov. 2012 (Year: 2012).*

(Continued)

*Primary Examiner* — Jie Yang
(74) *Attorney, Agent, or Firm* — Myers Bigel, P.A.

(57) ABSTRACT

There are provided a very thin martensitic stainless steel foil and a manufacturing method thereof, which are capable of reducing shape defects and the like. A martensitic stainless steel foil of the present invention has a thickness of at most 35 μm, and having a steepness of at most 0.75% when the steel foil has a length of 650 mm. Preferably, a metallographic structure in a cross-section of the steel foil is a ferrite structure, in which carbides are dispersed. More preferably, the steel foil consisting of, by mass, 0.25% to 1.5% C, 10% to 18% Cr, at most 1.0% Si (exclusive of 0%), at most 1.5% Mn (exclusive of 0%), at most 3.0% Mo (inclusive of 0%), and the balance of Fe with inevitable impurities.

4 Claims, 2 Drawing Sheets

(51) Int. Cl.

| | |
|---|---|
| ***C21D 9/48*** | (2006.01) |
| ***B21B 3/02*** | (2006.01) |
| ***C21D 8/04*** | (2006.01) |
| ***C21D 9/46*** | (2006.01) |
| ***C22C 38/00*** | (2006.01) |
| ***C21D 6/00*** | (2006.01) |
| ***C21D 8/02*** | (2006.01) |
| ***C22C 38/02*** | (2006.01) |
| ***C22C 38/04*** | (2006.01) |

(52) U.S. Cl.
CPC ..... *C21D 8/0236* (2013.01); *C21D 8/0436* (2013.01); *C21D 9/46* (2013.01); *C21D 9/48* (2013.01); *C22C 38/00* (2013.01); *C22C 38/02* (2013.01); *C22C 38/04* (2013.01); *B21B 2267/06* (2013.01); *C21D 2211/004* (2013.01); *C21D 2211/005* (2013.01); *C21D 2211/008* (2013.01)

(58) Field of Classification Search
CPC ..... C21D 2211/008; C21D 6/002; C21D 8/0236; C21D 8/0436; C21D 9/46; C21D 9/48
USPC ..... 148/352
See application file for complete search history.

(56) References Cited

FOREIGN PATENT DOCUMENTS

| | | | | |
|---|---|---|---|---|
| JP | 6-6749 | B2 | | 1/1994 |
| JP | 9-271817 | A | | 10/1997 |
| JP | 10-263615 | A | | 10/1998 |
| JP | 2002-294409 | A | | 10/2002 |
| JP | 2003-313612 | A | | 11/2003 |
| JP | 2009-302203 | A | | 12/2009 |
| JP | 2012214866 | A | * | 11/2012 |
| JP | 2015-167953 | A | | 9/2015 |
| WO | 2005/042797 | A1 | | 5/2005 |
| WO | WO 2005/101551 | A1 | | 10/2005 |

OTHER PUBLICATIONS

English language translation of the International Search Report, International Application No. PCT/JP2017/009238, dated Jun. 13, 2017, 1 pp.

The First Office Action and English language translation, CN Application No. 201780016118.5, dated Sep. 30, 2019, 12 pp.

Zhou Jun (ed.), World Steel Standard Book, Machinery Industry Press, Jan. 31, 1970, pp. 1067-1068 + 2 pp. English language translation.

Pan Huiqin (ed.), Rolling Mill Machinery and Equipment, Metallurgical Industry Press, Nov. 30, 1994, pp. 15-20 + 3 pp English language translation.

Wang Tingfu (ed.), Modern Steel Rolling, Metallurgical Industry Press, Aug. 31, 2014, pp. 318-325 + 16 pp. English language translation.

Tang Daiming (ed.), Metal Material Science, Xi'an Jiaotong University Press, Jun. 30, 2014, pp. 166-171 + 5 pp. English language translation.

Notification of Reason for Refusal and English language translation, KR Application No. 10-2018-7023559, dated Sep. 27, 2019, 9 pp.

* cited by examiner

* SIZES OF BUBBLES (○) INDICATE AMOUNTS OF LIFT OF RESPECTIVE PORTIONS FROM HORIZONTAL SURFACE PLATE

NUMERICAL VALUES IN GRAPH INDICATE LIFT HEIGHTS

MARTENSITIC STAINLESS STEEL FOIL AND MANUFACTURING METHOD THEREOF

RELATED APPLICATIONS

This application is a 35 U.S.C. § 371 national stage application of PCT Application No. PCT/JP2017/009238, filed on Mar. 8, 2017, which claims priority from Japanese Patent Application No. 2016-046217, filed on Mar. 9, 2016, the contents of which are incorporated herein by reference in their entireties. The above-referenced PCT International Application was published in the English language as International Publication No. WO 2017/154981 A1 on Sep. 14, 2017.

TECHNICAL FIELD

The present invention relates to a very thin martensitic stainless steel foil and to a manufacturing method thereof.

BACKGROUND ART

Martensitic stainless steel having high hardness and excellent abrasion resistance as well as corrosion resistance is used in bearings, valves, precision springs, blades, and the like. Among these products, some are in progress of improvements in precision and complexity. Accordingly, there is also a growing demand for reduction in plate thickness (such as below 0.1 mm) of martensitic stainless steel that serve as the material. Concerning techniques for the reduction in plate thickness, Patent Document 1 discloses an invention of grain-refined martensitic stainless steel for use in blades and the like, which is produced in accordance with a liquid quenching method and has a thickness of 0.04 mm (40 μm). Patent Document 2 describes a blade material for a razor, which is produced in accordance with a rapid solidification method, has 30% or more of an amorphous structure in total structures in terms of volume ratio, and has a material thickness in a range from 30 μm to 100 μm.

REFERENCE DOCUMENT LIST

Patent Documents

Patent Document 1: JP 2003-313612 A
Patent Document 2: JP 2002-294409 A

SUMMARY OF THE INVENTION

Problem to be Solved by the Invention

In the meantime, reduction in plate thickness of martensitic stainless steel according to a conventional manufacturing method including producing a steel piece in accordance with a smelting method and subjecting the steel piece to forging as well as hot and cold rolling has not been proposed. The inventions described in Patent Documents 1 and 2 also achieve the reduction in plate thickness by transforming a metallographic structure into an amorphous state by using a special method such as the liquid quenching method. When a steel foil having a thickness at most 40 μm, for example, can be manufactured by cold rolling as mentioned above, it is possible to adjust surface texture and to obtain a desired metallographic structure. Accordingly, applications of the steel foil can be expanded.

In view of the above, it is an object of the present invention to provide a martensitic stainless steel foil having a thickness of at most 35 pun, which is less than a conventional product, and to provide a manufacturing method thereof by a cold rolling.

Means for Solving the Problem

According to an embodiment of the present invention, there is provided a martensitic stainless steel foil, characterized in that the martensitic stainless steel foil has a thickness of at most 35 μm and has a steepness of at most 0.75% when the martensitic stainless steel foil has a length of 650 mm.

A metallographic structure in a cross-section of the martensitic stainless steel foil is preferably a ferrite structure, in which carbides are dispersed.

Preferably, the martensitic stainless steel foil consists of, by mass, 0.25% to 1.5% C, 10% to 18% Cr, at most 1.0% Si (exclusive of 0%), at most 1.5% Mn (exclusive of 0%), at most 3.0% Mo (inclusive of 0%), and the balance of Fe with inevitable impurities.

According to another embodiment of the present invention, there is provided a method for manufacturing a martensitic stainless steel foil, characterized in that a rolling rate in a finishing cold rolling step is in a range from 40 to 120 m/min, in that a work roll diameter for an intermediate pass in the finishing cold rolling step is at most 50 mm, and in that a work roll diameter for a final pass in the finishing cold rolling step is equal to or above the work roll diameter for the intermediate pass.

Effects of the Invention

According to the present invention, it is possible to obtain a very thin martensitic stainless steel foil that is capable of suppressing a shape defect and the like, and to provide a manufacturing method thereof.

MODE FOR CARRYING OUT THE INVENTION

Thickness of at Most 35 μm

Figure 1A:
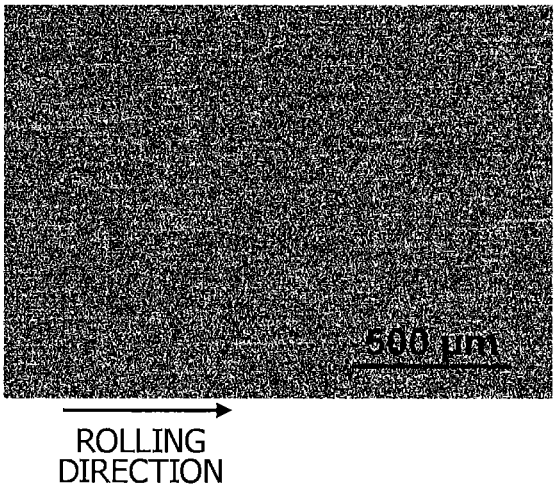
FIGS. 1A and 1B, referred to herein as FIG. 1, show micrographs at 50-fold magnification and at 500-fold magnification, respectively, of a surface of a martensitic stainless steel foil according to the present invention.

An embodiment of the present invention will be described below in detail. A first characteristic feature of a martensitic stainless steel foil (hereinafter simply referred to as a "steel foil" as appropriate) of the present invention is that its thickness is at most 35 μm. The thickness is preferably at most 30 μm. According to this feature, improvements are expected not only in pressing and cutting performances, but also in penetration workability by etching of the martensitic stainless steel foil, thereby increasing adaptability to versatile applications including products that require complicated shape forming or precision machining. A lower limit of the thickness is not limited to a particular value, but the thickness is preferably set at at least 10 μm, for example, in consideration of manufacturing limitations. Note that the term "martensitic stainless steel" in the present invention is stainless steel in the form of a steel trip with increased hardness as a consequence of transforming a metallographic structure of the steel strip into a martensitic structure by means of quenching.

Steepness

A second characteristic feature of the steel foil of the present invention is a steepness of at most 0.75% when the steel foil has a length of 650 mm in a rolling direction. The steepness is preferably at most 0.50%. According to this characteristic feature, it is possible to obtain a steel foil that can be processed in a complicated fashion or at high precision. Moreover, it is also possible to suppress creases that occur on the steel foil when rolling up the steel foil into a coil, and shape defects such as lateral bending at the time of cutting in the course of manufacturing the steel foil. A lower limit of the steepness is not limited to a particular value, but the steepness is preferably set at at least 0.01%, for example, because it is difficult to manufacture the steel foil into a completely flat shape (i.e., a steepness of 0.00%).

Note that the steepness in this embodiment may be measured in accordance with the following method, for example. First, the steel foil is cut into a prescribed length (650 mm in the rolling direction, for example). Then, the steel foil is placed on a horizontal surface plate and lift heights of the steel foil are measured by using a laser displacement meter or the like. Incidentally, while the steel strip having a width of 320 mm was used in the measurement of the steepness in this embodiment, the width is not limited to a particular value. The metal strip only needs to have such a width that enables the measurement of the steepness at the given length in the rolling direction. In this instance, the steepness can be derived from data of lift heights recorded in a matrix based on predetermined lengths in width and length directions of the steel foil. In order to measure the steepness at high accuracy, it is preferable to secure a certain length of a sample. In the present invention, the length for the measurement of the steepness is set to 650 mm because it is possible to maintain high reliability if a thin plate has a length of 650 mm or above.

In order to finish the very thin steel foil, the steel foil of the present invention is formed into a very thin state by cold rolling using a rolling mill, for example. In this instance, a surface of the steel foil of the present invention can be adjusted to a variety of surface roughnesses by rolling at a high rolling reduction ratio to produce the steel foil while adjusting a threading rate, an amount of rolling oil, and the like. For example, in order to increase adhesion to a coating or to increase adhesion of the steel foil to a resin such as a resist, it is preferable to adjust arithmetic surface roughness Ra at most 0.08 μm and a maximum height Rz at most 1 μm. A more preferable upper limit of the value Ra is 0.06 μm and a more preferable upper limit of the value Rz is 0.5 μm. Here, striations transferred from a rolling mill roll or oil pits formed as a consequence of drawing the rolling oil may be formed on a surface of the steel foil. Moderate striations are likely to serve as drainage for the rolling oil to suppress the development of the oil pits, so that an effect to obtain a steel plate having a more favorable surface shape can be expected. To obtain this effect, the surface roughness measured in a direction perpendicular to the rolling direction may be adjusted to be greater than the surface roughness measured in the rolling direction. Furthermore, the surface roughness measured in the direction perpendicular to the rolling direction is preferably greater than the surface roughness measured in the rolling direction by 0.005 μm or above in terms of the value Ra.

As for components of the martensitic stainless steel foil of the present invention, it is possible to apply the components as defined in JIS G 4303, modified steel components thereof, and other previously proposed compositions, for example. Meanwhile, in order to obtain a steel foil having greater strength, the martensitic stainless steel foil preferably consists of, by mass, 0.25% to 1.5% C, 10% to 18% Cr, at most 1.0% Si (exclusive of 0%), at most 1.5% Mn (exclusive of 0%), at most 3.0% Mo (inclusive of 0%), and the balance of Fe with inevitable impurities. Carbides can be formed by adopting this composition. Moreover, sizes of the carbides and a metallographic structure can be changed by heat treatments, and its hardness may be adjusted depending on its applications. Meanwhile, the metallographic structure of the steel foil of the present invention is preferably in the state in which the carbides are dispersed in a ferrite structure. By controlling the density and grain sizes of the carbides, it is possible to adjust a hardness property of the steel foil after quenching and tempering, for example.

Although the width of the steel foil of the present invention is not limited to a particular value, it is preferable to set the width after cold rolling to at least 100 mm, for example. By setting this large width, it is possible to slit the steel foil into desired product width later and to improve productivity at the time of etching as well. Meanwhile, in order to obtain the more favorable steepness, the width after cold rolling is set preferably at most 400 mm, for example, or more preferably at most 350 mm, or further more preferably at most 300 mm. This is due to the following reasons. Specifically, when the steel foil having a thickness of at most 35 μm is formed by cold rolling, a phenomenon in which work rolls come into contact with each other during the rolling, or so-called kiss-roll may occur depending on the type of the used rolling mill. Accordingly, the larger the width is, the more difficult it is to obtain the favorable steepness due to roll bending control and the like in the cold rolling.

A hardness of the steel foil of the present invention is preferably set in a range from 270 to 370 HV in terms of Vickers hardness, for example. This hardness is almost the same hardness as that of a conventional martensitic stainless steel strip having a thickness of 0.1 μm or more, for example, and it is therefore excellent in bending workability and drawing workability. A more preferable lower limit of the hardness is 290 HV and a more preferable upper limit of the hardness is 350 HV. Meanwhile, a tensile strength of the steel foil of the present invention is preferably set in a range from 880 to 1050 $N/mm^2$. This tensile strength is almost the same tensile strength as that of the conventional martensitic stainless steel strip having a thickness of at least 0.1 μm, for example. A more preferable lower limit of the tensile strength is 900 $N/mm^2$ and a more preferable upper limit of the tensile strength is 1000 $N/mm^2$. Note that the hardness and the tensile strength of the steel foil of the present invention can be adjusted as appropriate by changing a cold rolling rate and conditions of the heat treatment in accordance with applications of the steel foil. In order to suppress the occurrence of creases, folds, and the like at the time of transportation, for example, it is possible to attain the goal by making the hardness greater by increasing the cold rolling rate of the steel foil. In order to obtain the favorable workability, for example, it is possible to attain the goal by making the hardness lower by decreasing the cold rolling rate.

Next, a description will be given of a manufacturing method of the present invention that can yield the martensitic stainless steel foil of the present invention. The steel foil of the present invention is produced by performing a cold rolling step in which a hot rolled material having a thickness of at most 3 mm, for example, is subjected to a cold rolling and a heat treatment. There is a scale or a flaw on a surface of the material after the hot rolling, and thus, a lower limit of the thickness is, but is not limited to, preferably at least 0.5 mm for the purpose of removing such defects in a later step. If any of these defects remain on the surface of the material, a fracture may possibly originate from the defect at the time of the rolling in the course of manufacturing the steel foil having a thickness of at most 35 μm. Due to the reason mentioned above, a polishing step to remove the scale on the surface or a trimming step to remove a cracked part at an end portion of the material or to correct the shape thereof may be conducted in the cold rolling step. As a consequence of the cold rolling step, rolling striations in the rolling direction may be found on the surface of the steel foil. Here, an existing cold rolling mill can be used. Nonetheless, it is preferable to use a rolling mill that includes a bending mechanism for intermediate rolls and the work rolls because the mechanism makes it possible to control an extension ratio in a plate width direction by adjusting distribution of a rolling load in the plate width direction, and thus to obtain the favorable shape. In addition, as for a furnace to be used in the heat treatment step, various existing furnaces including a vertical furnace and a lateral furnace (a horizontal furnace) can be used. Nonetheless, in order to prevent the bending in the course of threading or to achieve the more favorable steepness, it is preferable to use a vertical furnace that is less likely to cause warpage due to the own weight.

The cold rolling step in the manufacturing method of the present invention includes a finishing cold rolling step to finish an intermediate cold rolled material, which is obtained by one or more of cold rolling into a thickness of about 0.1 mm, into a steel foil having a thickness of at most 35 μm by the cold rolling through rolling passes for multiple sessions. A rolling reduction ratio by an intermediate rolling pass in this finishing cold rolling can be set at most 35%. By setting this rolling reduction ratio, it is possible to reduce a rolling load in each rolling pass and to suppress the occurrence of a fracture at the time of the rolling and of roughness on the surface of the material. A more preferable rolling reduction ratio by each rolling pass is at most 30%.

Moreover, in the manufacturing method of the present invention, a work roll diameter used in the intermediate pass of the finishing cold rolling step mentioned above is set at most at 50 mm, or preferably at most at 40 mm, or more preferably at most at 30 mm. By setting the work roll diameter as described above, it is possible to efficiently roll the steel foil having the small plate thickness while reducing the rolling loads. As used in this description, an intermediate pass means any of finishing cold rolling passes except a final pass, to be described below.

The manufacturing method of the present invention is characterized in that a work roll diameter used in a final pass of the finishing cold rolling step is set equal to or greater than the work roll diameter used in the intermediate pass. By setting the work roll diameter as described above, it is possible to increase rigidity of each roll and to suppress flattening deformation and the like of the roll, thereby obtaining a flatter shape. Preferably, the work roll diameter used in the final pass of the finishing cold rolling is set to be greater than the work roll diameter used in the intermediate pass. The work roll diameter for the final pass is preferably at least 60 mm, more preferably at least 70 mm, or further more preferably at least 80 mm. In this instance, a rolling reduction ratio by the final pass may be set at most at 25%. A hardness of a final product may be adjusted to a desired hardness by conducting softening annealing before the final pass.

In the manufacturing method of the present invention, a rolling rate at the time of finishing cold rolling is set preferably in a range from 40 to 120 m/min. If the rolling rate is too low, the rolling load is increased and the favorable shape is difficult to obtain. In addition, rolling efficiency also tends to be deteriorated. On the other hand, it is possible to conduct the rolling while reducing the rolling load by utilizing a speed effect while increasing the rolling rate. However, if the rolling rate is too high, an amount of the rolling oil to be taken out is increased, whereby the material being rolled up is prone to telescoping. Accordingly, by adjusting the rolling rate within the aforementioned range, it is possible to suppress the material telescoping while obtaining the favorable shape. A more preferable lower limit of the rolling rate is 50 m/min and a further more preferable lower limit thereof is 70 m/min. Meanwhile, a more preferable upper limit of the rolling rate is 110 m/min and a further more preferable upper limit thereof is 100 m/min.

In order to obtain a desired size, the martensitic stainless steel foil of the present invention may be subjected to a slitting step to cut the wide steel foil after the cold rolling step into multiple strips. Since the steel foil of the present invention has the favorable steepness, it is possible to obtain an excellent metal strip that is less likely to cause lateral bending even after the slitting.

EXAMPLE

The present invention will be described below in further detail with reference to the following example.

Figure 1B:
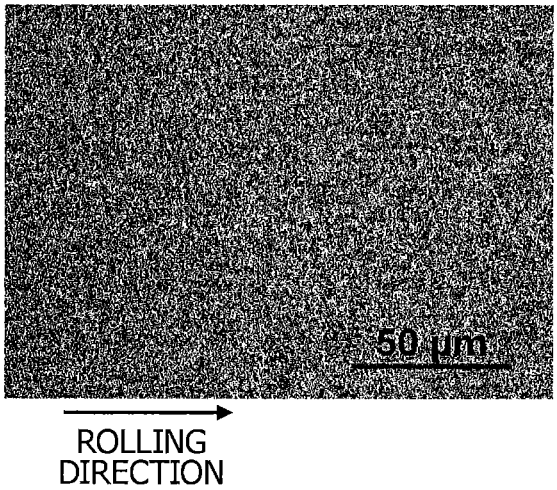
Figure 2:
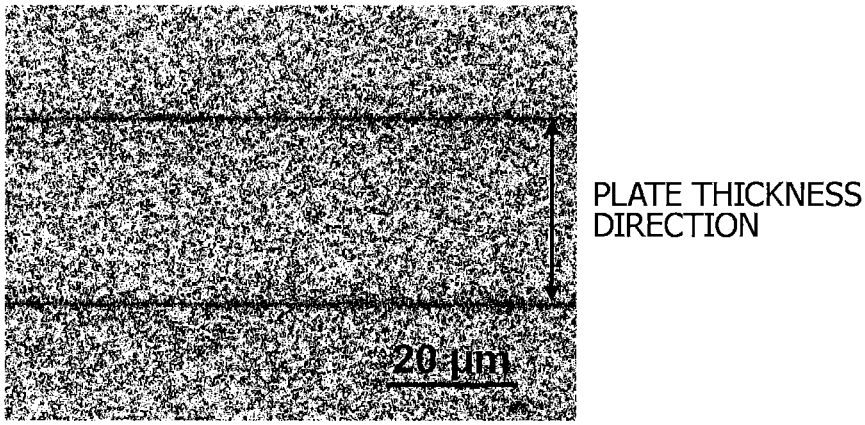
FIG. 2 shows a micrograph of a cross-section, which is perpendicular to a plate width direction, of a martensitic stainless steel foil according to the present invention.

After producing a steel ingot of martensitic stainless steel having the composition shown in Table 1, a hot rolled material having a thickness of 1.5 mm was produced by conducting forging and hot rolling. Thereafter, the hot rolled material was subjected to surface polishing and rough rolling, and the two end portions in the width direction of the material were removed by the trimming to prepare a material to be cold rolled. Subsequently, this material to be cold rolled was repeatedly subjected to cold rolling and heat treatment to produce an intermediate cold rolled material having a thickness of about 0.1 mm. The intermediate cold rolled material was subjected to finishing cold rolling to produce a martensitic stainless steel foil having a thickness of 30 μm as Example No. 1 of the present invention. In the finishing cold rolling step for the example of the present invention, the cold rolling was conducted for four passes (i.e., intermediate passes) while setting the work roll diameter to 30 mm, a rolling reduction ratio for each pass in a range from 18% to 30%, and a rolling rate in a range from 40 to 110 m/min. In addition, after softening annealing, cold rolling (i.e., final pass) was conducted at a rolling reduction ratio of about 17% by changing the work roll diameter to 80 mm. As Comparative Example No. 11, after producing a steel ingot having the composition shown in Table 1, an intermediate material having a thickness of about 0.11 mm was produced by conducting similar processes to those in the example of the present invention. Thereafter, a martensitic stainless steel strip having a thickness of 0.1 mm was produced by conducting one pass of finishing cold rolling. In the finishing rolling step of the comparative example, the work roll diameter was set to 120 mm and the rolling rate was set to about 180 m/min. FIG. 1 shows micrographs of the surface of the martensitic stainless steel foil of the example of the present invention, and FIG. 2 shows a micrograph of the cross-section thereof. As shown in FIG. 1, it is possible to confirm that the surface of the steel foil of the present invention is formed into a lusterless rolled surface with striations oriented in the rolling direction by processing the steel foil by the cold rolling. Meanwhile, in FIG. 2, in order to observe the metallographic structure, the obtained steel foil was layered and the structure thereof was observed from the cross-sectional direction. From FIG. 2, it was confirmed that steel foil exhibited the metallographic structure in which carbides were dispersed in a ferrite structure. In FIG. 2, a portion indicated as a plate thickness direction represents one layer of the steel foil, and portions thereabove and therebelow represent other layered steel foils. The right-left direction of FIG. 2 is the width direction (the direction perpendicular to the rolling direction).

TABLE 1

| (mass %) | | | | |
|---|---|---|---|---|
| C | Si | Mn | Cr | Balance |
| 0.68 | 0.29 | 0.73 | 13.26 | Fe and unavoidable impurities |

Figure 3:
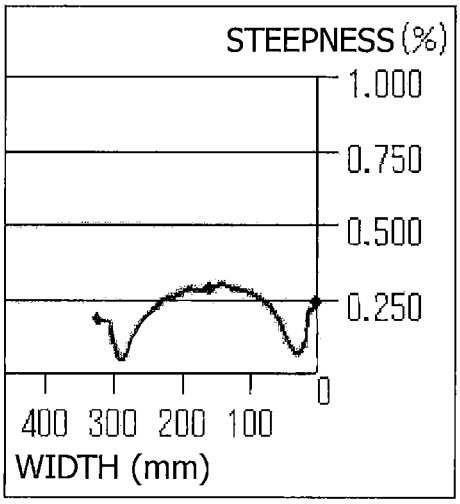
FIG. 3 shows a measurement result of a steepness of a martensitic stainless steel foil according to the present invention.
Figure 4:
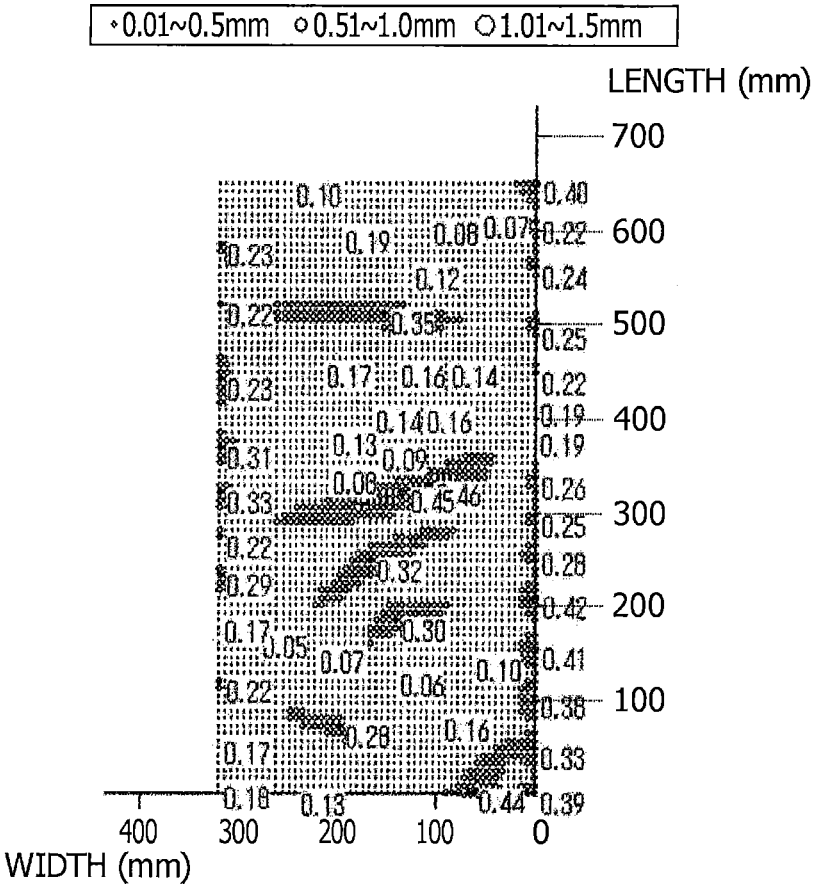
FIG. 4 shows a measurement result of lift heights of a martensitic stainless steel foil according to the present invention.

Subsequently, the steel foil of the present invention was subjected to measurement of the steepness and the Vickers hardness. As for a method of measuring the steepness, a test piece having a length of 650 mm and a width of 320 mm is first cut out of the martensitic stainless steel foil of the present invention. In this case, the length direction is the rolling direction. Then, the test piece in a state of being placed on a horizontal surface plate was evaluated in terms of lift heights by using a three-dimensional profilometer. As for the Vickers hardness, values of hardness were measured at five points at two end portions in the width direction as well as a central portion in the width direction of the steel foil while applying a load of 0.490 N in accordance with a method as defined in JIS-Z2244, and an average value was calculated therefrom. As for the tensile strength, five JIS 13B test pieces were collected from the central portion in the width direction of the steel foil. The test pieces were subjected to measurement in accordance with a method as defined in JIS-Z2241, and an average value was calculated therefrom. As for the surface roughness, a length of 4 mm was measured with a contact type surface roughness meter, and the arithmetic average roughness Ra and the maximum height Rz were thus measured. Measurement results are shown in Table 2 and Table 3. In addition, the measurement result of the steepness of the martensitic stainless steel foil of the example of the present invention is shown in FIG. 3 while the measurement result of the lift heights of the martensitic stainless steel foil of the example of the present invention is shown in FIG. 4. Table 2, FIG. 3, and FIG. 4 showed that the martensitic stainless steel foil of the example of the present invention had excellent values including the lift heights from the horizontal surface plate at most 0.5 mm and the steepness of 0.3% at the maximum. From these results, it was confirmed that the martensitic stainless steel foil of the present invention had favorable steepness in spite of its very thin profile. On the other hand, it was confirmed that the steel strip of the comparative example, to which the manufacturing method of the present invention was not applied, and which was therefore thicker than that of the present invention, had values of the maximum lift height and the maximum steepness which are inferior to those of the example of the present invention. It was also confirmed that the hardness and the tensile strength of the steel foil according to the example of the present invention were substantially equal to corresponding values in the conventional example, and that the steel foil had a very flat and smooth surface.

TABLE 2

| | Hardness | | | | | | |
|---|---|---|---|---|---|---|---|
| No. | Central portion in width direction | First end portion in width direction (HV) | Second end portion in with direction | Average tensile strength ($N/mm^2$) | Maximum lift height (mm) | Maximum steepness (%) | Remarks |
| 1 | 320 | 321 | 318 | 924 | 0.46 | 0.3 | Example of present invention |
| 11 | 324 | 316 | 320 | 944 | 1.32 | 0.8 | Comparative example |

TABLE 3

| | Surface roughness | | | | |
|---|---|---|---|---|---|
| | Ra | | Rz | | |
| No. | Rolling direction (μm) | Width direction (μm) | Rolling direction (μm) | Width direction (μm) | Remarks |
| 1 | 0.049 | 0.055 | 0.456 | 0.465 | Example of present invention |

The invention claimed is:

1. A martensitic stainless steel foil, which is stainless steel foil of which a metallographic structure is transformed into a martensitic structure by means of quenching, wherein the martensitic stainless steel foil has a thickness of at most 35 μm, and has a steepness of at most 0.75% when the martensitic stainless steel foil has a length of 650 mm, and wherein a metallographic structure in a cross-section of the martensitic stainless steel foil is a ferrite structure, in which carbides are dispersed.

2. The martensitic stainless steel foil according to claim 1, wherein the martensitic stainless steel foil consists of, by mass, 0.25% to 1.5% C, 10% to 18% Cr, at most 1.0% Si (exclusive of 0%), at most 1.5% Mn (exclusive of 0%), at most 3.0% Mo (inclusive of 0%), and the balance of Fe with inevitable impurities.

3. The martensitic stainless steel foil according to claim 1, wherein the martensitic stainless steel foil is a rolled foil.

4. A method for manufacturing a martensitic stainless steel foil, which is stainless steel foil of which a metallographic structure is transformed into a martensitic structure by means of quenching, wherein a rolling rate in a finishing cold rolling step is in a range from 40 to 120 m/min, a work roll diameter for an intermediate pass in the finishing cold rolling step is at most 50 mm, and a work roll diameter for a final pass in the finishing cold rolling step is at least 60 mm, and the finishing cold rolling step produces the martensitic stainless steel foil having a thickness of at most 35 μm, and having a steepness of at most 0.75% when the martensitic stainless steel foil has a length of 650 mm, wherein a metallographic structure in a cross-section of the martensitic stainless steel foil is a ferrite structure, in which carbides are dispersed.

* * * * *